United States Patent [19]

Guthrie

[11] 4,063,770

[45] Dec. 20, 1977

[54] CARGO CONTAINER SPREADER WITH GUIDE APPARATUS

[75] Inventor: Dale H. Guthrie, Roxboro, N.C.

[73] Assignee: RPC Corporation, Roxboro, N.C.

[21] Appl. No.: 575,936

[22] Filed: May 9, 1975

[51] Int. Cl.[2] ..... B66C 1/10

[52] U.S. Cl. ..... 294/81 SF; 294/67 DA

[58] Field of Search ..... 294/67 R, 67 D, 67 B, 294/67 DA, 81 R, 81 SF, 88; 214/621

[56] References Cited

U.S. PATENT DOCUMENTS

| | | | |
|---|---|---|---|
| 3,078,115 | 2/1963 | Harlander et al. | 294/81 SF UX |
| 3,151,904 | 10/1964 | Tantlinger et al. | 294/67 DA |
| 3,428,354 | 2/1969 | Griffith | 294/67 R |
| 3,453,017 | 7/1969 | Nagy | 294/81 SF X |
| 3,458,229 | 7/1969 | Nagy et al. | 294/81 SF |
| 3,498,473 | 3/1970 | Spaulding et al. | 294/67 R X |
| 3,780,877 | 12/1973 | Levitt | 294/81 SF X |
| 3,885,676 | 5/1975 | Wilson et al. | 294/81 SF X |

*Primary Examiner*—Johnny D. Cherry
*Attorney, Agent, or Firm*—John H. Mulholland

[57] ABSTRACT

A cargo-container spreader providing retractable guides and bell crank and link mechanism for operating the guides which may be substantially contained within the frame region of the spreader. The guides are adaptable for both power and manual operation.

8 Claims, 7 Drawing Figures

CARGO CONTAINER SPREADER WITH GUIDE APPARATUS

BACKGROUND OF THE INVENTION

In the early development of cargo-container handling systems, one initial and basic requirement was the guiding of spreaders into coupling relation with cargo containers. Vigorous efforts to provide guide devices have caused a number of designs, some proprietary, to emerge. Among the most successful is the type of guide located at the corners of a spreader comprising a linearly L-shaped member forming a lower transversely dihedral portion with a flaring skirt adapting it to fit around a vertically extending corner of a container. This type of guide may be fitted with a lower planate section and mounted between corners over a spreader frame side or end rail. Such a guide is ordinarily operated by a circular hydraulic motor in coaxial relation with a swing axis of the guide located in laterally inward relation with the periphery of the frame. There are other types of guides in use which engage the vertical sides rather than the corners of a container. Many of the guide mechanisms are not adaptable for manual operation. An object of the present invention is to provide an alternate mechanism for operating guides of L-shaped configuration which may be located inwardly of the vertical as well as the horizontal periphery of the spreader frame. It is further desirable that an actuating mechanism be provided which is adapted for operating guides at any point along the horizontal periphery of the frame. Another object is to provide mechanism of simple inexpensive design adaptable for either manual or power operation. Manual operation is important in low cost spreaders which are provided for occasional use and are constructed without electrical or hydraulic servomechanisms.

SUMMARY OF THE INVENTION

The present invention resides in a cargo-container spreader equipped with pivotably retractable guides spaced along a generally horizontal rectangle approximately outlining the periphery of the spreader frame, and with a mechanism for raising and lowering each guide compactly received essentially within the region occupied by the frame of the spreader. The mechanism for each guide includes a link connected with the guide, a bell crank, and an operating device connected in series relationship in the order named which remain during operation within the general vertical and horizontal profiles of the frame. The operating device may, e.g., be a fluid power cylinder motor or a hand operated rack and pinion assembly having one portion anchored to the frame and a reciprocating portion connected with the bell crank.

In the preferred form of the invention, a unique cycle of motion results from the proportioning of actuating parts to achieve very short strokes by means, such as a fluid cylinder motor. Such short strokes result from the rise to relatively high leverage values within the actuating parts to overcome static inertia of the guide near the ends of the strokes, and relatively low leverage values through intermediate portions of the strokes during which dynamic inertia of the guide is established and little stroke movement need be expended by the motor. This is accomplished by positioning and proportioning the leverage system so that a distal portion of the bell crank swings closely to the swing axis of the guide during an intermediate portion of its stroke.

DESCRIPTION OF THE PREFERRED EMBODIMENTS

Figure 1:
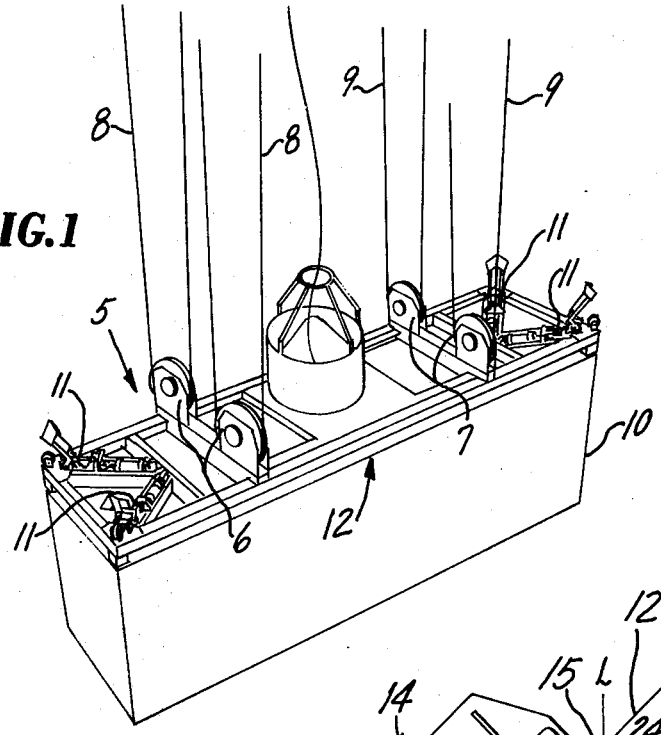
FIG. 1 is a perspective view of a spreader in accordance with the invention shown loaded and interlocked with a cargo container.

FIG. 1 illustrates the environment in which the invention is operable. Shown therein is a spreader 5 having sheave blocks 6,7 by which the spreader is suspended on cables 8,9. The spreader is shown interlocked with a container 10. The corner guides 11 are shown in raised positions in which they are within a vertical projection of a horizontal rectangle outlining frame or periphery of the spreader 5. The guides 11 are thus positioned for passage of the spreader and container through deck openings of a container ship. The spreader 5 has a frame 12 which comprises various longitudinal and transverse members arranged in such a manner as to accommodate mechanisms for raising and lowering the guides herein below described.

As one embodiment of guides 11, FIS. 2 and 3 depict an L-shaped corner-type guide 14 comprising L-shaped brackets 15,16, a dihedral plate element 17 adapted to fit the vertical corner of a container, and a gathering apron 18 joining section 17 along its lower edge. Element 17 and apron 18 form the distal container engaging portion of the guide. Guide 14 swings on a horizontal axis N—N as a result of its proximal portion being supported on a shaft 21 extending through hub portions 22, 23 of brackts 15,16, respectively, and bearings 24,25 fixed to the spreader frame 12. As found in present spreader design, the frame 12 supports a roller 27 on an axis of rotation in fixed relation with the frame for the purpose of projecting horizontally beyond the vertical corner surfaces of the spreader frame and any container interlocked with the spreader to engage cell staunchions of container ships and the like when the guides are in raised position.

Figure 3:
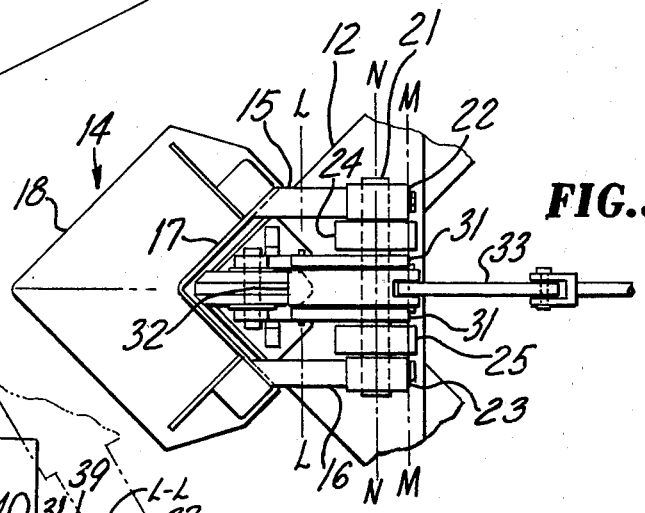
FIG. 3 is a fragmentary plan view of the guide and mechanism shown in FIG. 2 shifted to its operating or "down" position.
Figure 2:
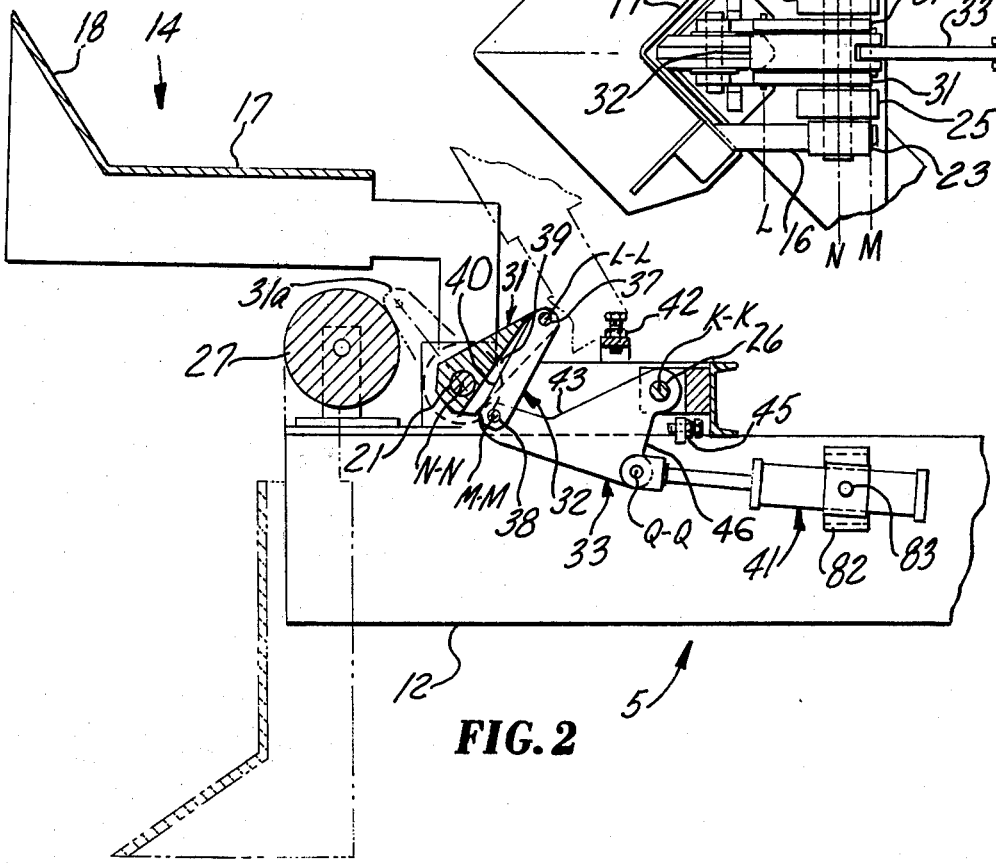
FIG. 2 is a fragmentary schematic elevation view of a partially retracted guide and the actuating mechanism associated therewith for raising and lowering the guide.
Figure 4:
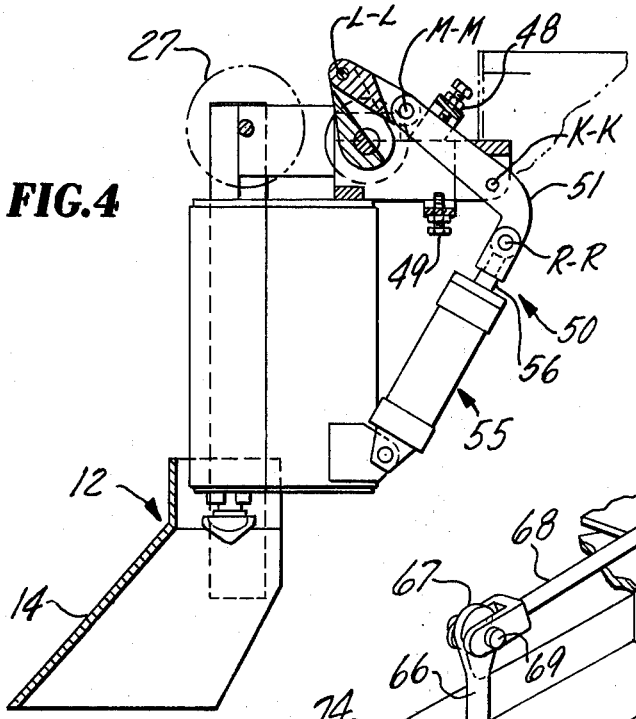
FIG. 4 is a fragmentary schematic view of a guide and associated modified actuating mechanism.
Figure 5:
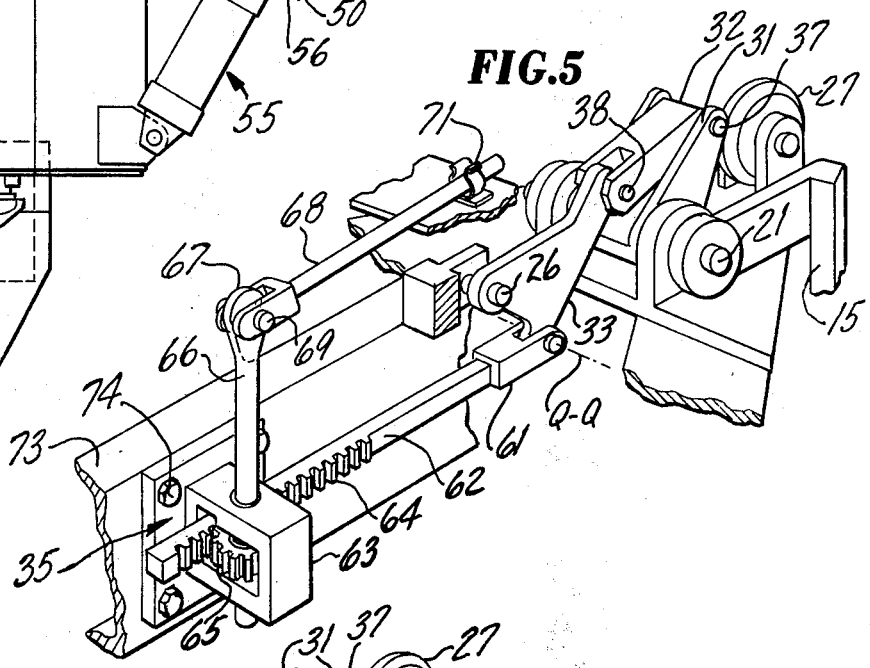
FIG. 5 is a fragmentary perspective view primarily of moving parts of a guide actuating system utilizing a manual operating device.
Figure 6:
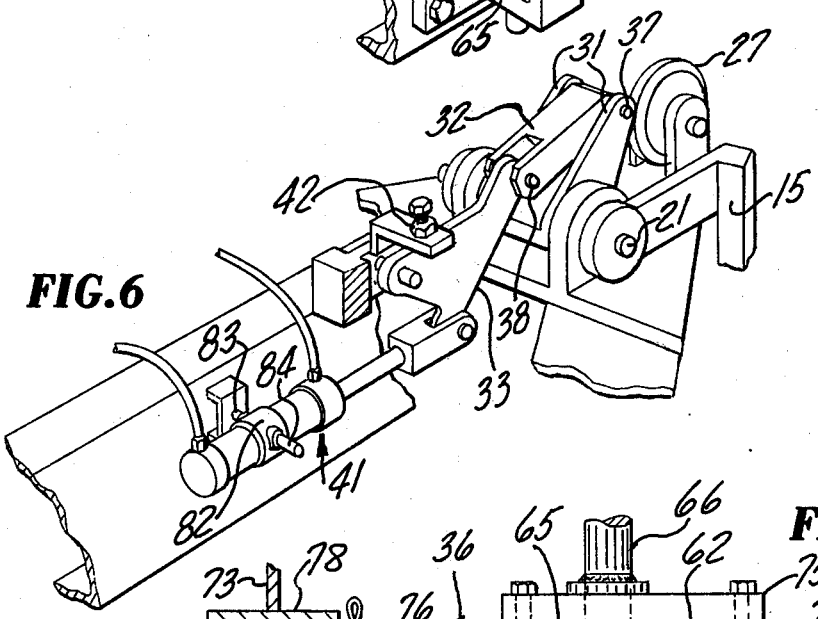
FIG. 6 is a fragmentary perspective view especially of moving parts of a guide and its actuating system including a power cylinder motor.
Figure 7:
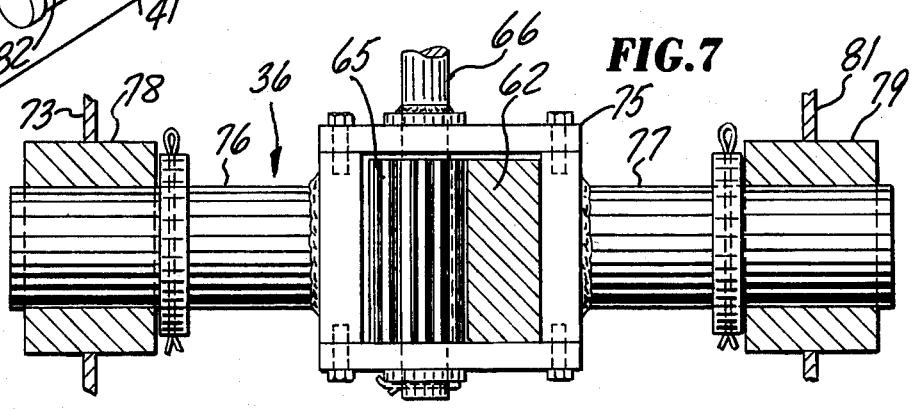
FIG. 7 is a fragmentary elevation of a manual rack and pinion actuating device modified with respect to that shown in FIG. 5.

With attention now to the main improvement arising out of the invention, and with reference to the embodiment illustrated in FIGS. 2 and 3, a mechanism for swinging the guide 14 about its swing axis N—N comprises a lever 31, a link 32, a bell crank 33, and actuating means such as either one of the manually operated devices 35,36 of FIGS. 5 and 7, respectively, or the power operated devices 41 and 55 of FIGS. 4 and 6.

Considering now the geometry of the lever, link, and bell crank arrangement, the lever 31, at the operative "down" position shown in full line in FIGS. 3 and 6, extends in an upward laterally outward direction away from the swing axis and end within a vertical projection of the generally horizontal rectangle which outlines the frame 12. FIG. 2 shows positions of the movable elements at a partially raised position of the guide. As shown in ghost outline 31*a*, the longitudinal axis of lever 31 has an angle of approximately 50° with the horizontal direction of the spreader. In the incompletely retracted position of the guide 14 shown in FIG. 2 in full outline, the lever 31 is shown displaced through approximately 90° from the down position. The range of angular displacement to achieve retraction of the guides within an upward projection of the spreader periphery, or container supported thereon, will depend somewhat on a vertical length of the guide at their down position. The guide swinging system herein disclosed readily permits much greater range of movement of the lever 31, e.g., up to 120° or more of angular range.

By way of connecting the various elements of the guide swinging system, FIG. 2 shows that the bell crank 33 is connected to the frame by a pin 26 along an axis K—K in fixed relation with the frame 12. The bell crank 33 and the lever 31 are interconnected by attachment of the link 32 thereto by pins 37,38 along axes L—L and M—M, respectively. The effective lengths of each of the elements of this system are measured between pairs of the above named axes which pass through any one of elements 31,32,33. It may be noted that the effective lengths of the lever 31 and the link 32 are approximately equal. Axis K—K is spaced with respect to axis N—N to enable the ends of the link and the bell crank pierced by axis M—M to pass as closely as structure permits to the axis N—N during propulsion of the guide 14 from one position to the other. To accomplish this end, it is advantageous to provide lever 31 in the form of a clevis or yoke as shown having a recessed region 39 spacing bifurcated or eye portions for receiving an end of the link 32 and the pin 37. It will be noted that the recess 39 opens the lever 31 to the surface of the shaft 21. At a portion of the way between the two extreme positions of the guide 14, the surface 40 of the link moves into close proximity if not actual contact with the shaft 21. When the ratio of the bell crank leg length between axes K—K and M—M with a lever length between axis N—N and axis L—L is approximately 3 to 2, one hundred degrees of angular travel of the guide 14 may be effected by approximately 25° of angular travel of the bell crank 33 about its axis K—K.

The bell crank 33 has its fulcrum point on axis K—K and its two distal points of connection revolving about axis K—K are (1) at axis M—M with link 32 and (2) connection with a push-and-pull means, such as the fluid cylinder motor 41 at axis Q—Q. Assuming an effective lever 31 length of 5 inches, a distance between axes M—M and K—K, i.e., one leg of the bell crank, of about 8 inches, and the distance between axes K—K and Q—Q, i.e., the other leg of the bell crank of about 4.5 inches, an exceedingly small stroke of the motor 41 is required. To effect one hundred degrees of angular travel of the guide 14, the piston stroke of the motor 41 may be of the order of 1.5 to 1.75 inches. As shown in FIGS. 2 and 6, the motor 41 contracts linearly to raise the guide to "up" position. This suprisingly short piston stroke results in change of leverage values exerted by the bell crank on the lever 31 from relatively high values near both ends of the stroke to relatively low values through an intermediate portion of the stroke. The high values of leverage are useful in overcoming the starting inertia of the guide 14. Once started, the guide may continue movement through application of lower leverage values.

Another advantage of the lever and link design shown in FIGS. 2 and 4 is that, at the down position of the guide, axes N—N, L—L, and M—M are in substantially straight line alignment. The upward motion of the bell crank to achieve the down position of the guide may be limited by means such as a set screw 42 in fixed relation with the spreader frame and engageable with a bell crank surface 43. Means for limiting the movement of the bell crank to effect the up or retracted position of the guide may be provided, such as the set screw 45 in fixed relation with the spreader frame and engageable with surface 46 of the bell crank.

In another embodiment, FIG. 4 illustrates similar stops 48,49 for limiting the movement of a bell crank 51 of a modified lever system in achieving the down and the up positions, respectively, of the guide 14. It may be noted in FIG. 4 that axes L—L, M—M, and K—K are related by distances similarly proportioned to those occurring in the embodiment illustrated in FIG. 2 and, at the down position of the guide, these axes are approximately aligned in the desirable straight line relationship which enables the pivot shafts at the axes to absorb the loading on the guide actuating system which results when the guide engages a container or other object at considerable lateral force. Bell crank 51 of FIG. 4 is actuated by a fluid cylinder motor 55 anchored by one end to the spreader frame. The motor 55 expands with outward movement of its piston rod 56 to achieve the up position of the guide.

FIG. 5 illustrates essentially the lever system of FIG. 2 with a manual operating device 35 which replaces the fluid cylinder motor 41 of the earlier described apparatus. The distal portion of the bell crank 33 traversed by axis Q—Q is connected with the clevis end 61 of a rack gear 62 extending through a bracket 63. Teeth 64 of the rack mesh with a pinion 65 keyed to a shaft 66 in bearing relation with the bracket 63. The shaft defines a terminal eye portion 67 to which is attached a clevis end portion of a handle 68 by a pin 69. The gears 62,65 are held in fixed position when the handle is received in detent means, such as the spring clip 71. The teeth 64 of the rack gear may be tapered in a way to allow some vertical angling of the rack gear within the bracket 63 resulting from a movement of the bell crank about its fulcrum pin 36. As shown, the bracket 63 is secured to a frame member 73 by bolts 74.

FIG. 7 illustrates a rack and pinion gear arrangement which may be substituted for that shown in FIG. 5. In FIG. 7, the rack gear 62 and the pinion 65 are supported in meshing relationship by a cage 75 comprising trunnions 76,77 rotatable within bearings 78,79 extending through and secured to frame members 73,81. This arrangement enables tilting of the cage in accordance with vertical angling of the rack gear 62 and the use of standard teeth on the rack gear and pinion. Rotation of the pinion 65 is effected as already described with respect to FIG. 5 by means such as the handle 68.

FIG. 6 is a view essentially of the apparatus shown in FIG. 2. To save space, the body of the fluid cylinder is shown supported midway along its length by trunnion bracket 82 having trunnions 83,84 received in bearings (not shown) in fixed relation with the spreader frame. By this construction, the fluid cylinder 41 is free to make angular movements in a vertical plane in accordance with changes of position of the bell crank 33.

What is claimed is:

1. A cargo-container spreader having a frame and L-shaped guides located along a generally horizontal rectangle outlining the frame, each of said guides having a proximal portion and a distal portion contiguous therewith which extends, at operative position, downward from said rectangle alongside a region occupied by a container when attached to said spreader, pivotal supporting means for each guide fixed to said frame providing a swing axis for the guide located laterally inward of the periphery of the rectangle pivotally connecting with said proximal portion of the guide enabling said guide to be swung to an upward position of storage within a vertical projection of said rectangle; and operating means for shifting each guide from one of said positions to the other comprising:

lever means in fixed relation with each guide and having pivotal connective means radially spaced an effective lever length from said swing axis, said lever means being contained within a vertical projection of said rectangle at any position of the guide;

link means having one end portion connected with said pivotal connective means;

bell crank means having two distal means at opposite ends and an intermediate fulcrum means adapted for making pivotal connections, one of said distal means being pivotally connected with the other end portion of said link means;

means fixed to the frame pivotally connecting with said fulcrum means;

operating means located inwardly of said frame having one portion connected with the frame and another portion reciprocable with respect to the frame and connected to the other distal means to rotate said bell crank means, said bell crank means being located relative to the guide to swing said first named distal means through a path in close proximity to the swing axis.

2. The cargo-container spreader of claim 1 wherein:

said lever means extends in an upward laterally outward direction away from said swing axis within a vertical projection of said rectangle at the operative position of the guide; and the effective length of said link means is not substantially greater than said effective lever length.

3. The cargo-container spreader of claim 2 wherein:

the axes of connection of the link means to the lever means, the link means to said bell crank means, and said fulcrum are parallel and aligned substantially within a plane at said operative position.

4. The cargo-container spreader of claim 1 wherein:

said operating means is a fluid cylinder connected to the frame at a point substantially horizontally distant from said other distal means and said fluid cylinder contracts to raise said guide out of operative position.

5. The cargo-container spreader of claim 1 wherein:

said operating means is a power cylinder extending downwardly relative to said other distal means into connection with said frame and said power cylinder expands to raise said guide out of operative position.

6. The cargo-container spreader of claim 1 wherein:

said operating means comprises a rack gear extending horizontally from a connection thereof with said other distal means, a housing through which said rack gear extends, a pinion received in said housing in meshing relation with said rack gear, an operating shaft extending through said housing and said rack gear in bearing relation with the housing and keyed relation with the pinion, handle means attached to an upper end of the shaft for rotation thereof.

7. The cargo-container spreader of claim 6 wherein:

said handle means is an elongated element pivotally connected to the shaft along a substantially horizontal axis.

8. The cargo-container spreader of claim 1 including stops positioned for engagement with said bellcrank means when said bellcrank means is moved between positions for moving said guide between said operative and storage positions.

* * * * *